United States Patent [19]

Honda et al.

[11] Patent Number: 4,653,375

[45] Date of Patent: Mar. 31, 1987

[54] ELECTRONIC INSTRUMENT HAVING A REMOTE PLAYING UNIT

[75] Inventors: Toyoharu Honda, Hachioji; Masaru Futami, Fujisawa, both of Japan

[73] Assignee: Victor Company of Japan, Ltd., Japan

[21] Appl. No.: 765,856

[22] Filed: Aug. 14, 1985

[30] Foreign Application Priority Data

Aug. 21, 1984 [JP] Japan ..... 59-126619[U]

[51] Int. Cl.[4] ..... G10H 1/38; G10H 7/00

[52] U.S. Cl. ..... 84/1.01; 84/1.03; 84/1.17

[58] Field of Search ..... 84/1.01, 1.03, 1.07, 84/1.08, 1.17, 1.24, DIG. 7, DIG. 12, DIG. 22, DIG. 25

[56] References Cited

U.S. PATENT DOCUMENTS

| | | | |
|---|---|---|---|
| 1,956,350 | 4/1934 | Hammond | 84/DIG. 25 |
| 3,941,023 | 3/1976 | Thomas et al. | 84/1.01 |
| 3,962,945 | 6/1976 | Creager et al. | 84/1.01 |
| 4,226,154 | 10/1980 | Easler | 84/1.01 |
| 4,276,801 | 7/1981 | Yerusavage | 84/1.01 |
| 4,344,345 | 8/1982 | Sano | 84/1.03 |
| 4,570,521 | 2/1986 | Fox | 84/1.01 |

*Primary Examiner*—Stanley J. Witkowski

*Attorney, Agent, or Firm*—Andrus, Sceales, Starke & Sawall

[57] ABSTRACT

An electronic instrument comprises a main electronic keyboard instrument body and a remote playing unit. The main electronic keyboard instrument body includes a keyboard, a sound generating circuit, and a processing circuit for discriminating a chord responsive to a manipulation of the keyboard and for determining a scale in accordance with the chord. The processing circuit causes the sound generating circuit to generate sound in accordance with the determined scale with a designated timing. The remote playing unit is electrically coupled to the main electronic keyboard instrument body, and comprises a plurality of elongated bar switches arranged side by side with an interval between two mutually adjacent bar switches. The timing with which the sound is generated by the main electronic keyboard instrument body is designated by manipulating and closing the bar switches.

7 Claims, 8 Drawing Figures

ELECTRONIC INSTRUMENT HAVING A REMOTE PLAYING UNIT

BACKGROUND OF THE INVENTION

The present invention generally relates to electronic instruments having a remote playing unit, and more particularly to an electronic instrument having such a construction that a remote playing unit which is capable of making a strumming performance of a guitar can be coupled to a main electronic keyboard instrument body.

Generally, an electronic instrument comprises a keyboard similar to that of a piano or an organ, and sounds obtained from an electronic circuit responsive to the playing of keys of the keyboard are generated through a speaker. This type of an electronic instrument can selectively generate sounds closely approximating the sounds of various actual instruments. For example, although the electronic instrument is a keyboard instrument, it is possible to generate the sounds of string instruments in addition to the sounds of wind instruments and percussion instruments. Among the sounds of various instruments, the electronic instrument can also generate the sounds of a guitar.

Out of the various methods of playing the guitar, there is a method of sequentially playing each of the six strings of the guitar with a slight mutual time difference so as to obtain a broken chord, that is, in the form of arpeggio. Such a method of playing the guitar will hereinafter be referred to as a strumming method. However, in order to generate the sounds of the guitar played by the strumming method on the electronic instrument, the player must sequentially play six keys of the keyboard with a short mutual time difference. But for a player who is not used to playing a keyboard instrument, there is a problem in that it is difficult to sequentially play the keys with a short mutual time difference.

SUMMARY OF THE INVENTION

Accordingly, it is a general object of the present invention to provide a novel and useful electronic instrument having a remote playing unit, in which the problems described heretofore are eliminated.

Another and more specific object of the present invention is to provide an electronic instrument having a remote playing unit which comprises bar switches corresponding to the strings of a guitar, wherein the remote playing unit is coupled to a main electronic keyboard instrument body and a sound of each of the notes which make up a chord and is assigned to each bar switch is generated by sequentially pushing the bar switches of the remote playing unit. According to the electronic instrument of the present invention, even a beginner can easily generate the sounds of the guitar played by the strumming method by sequentially manipulating by his fingers the bar switches which are generally arranged side by side on the remote playing unit.

Still another object of the present invention is to provide an electronic instrument having a remote playing unit which comprises a plurality of bar switches arranged in such a manner that each interval between two mutually adjacent bar switches is small on one end of the bar switch and is large on the other end of the bar switch. According to the electronic instrument of the present invention, both an adult having big hands and a child having small hands can easily generate the sounds of a guitar which is played slowly or quickly by the strumming method.

Other objects and further features of the present invention will be apparent from the following detailed description when read in conjunction with the accompanying drawings.

DETAILED DESCRIPTION

Figure 1:
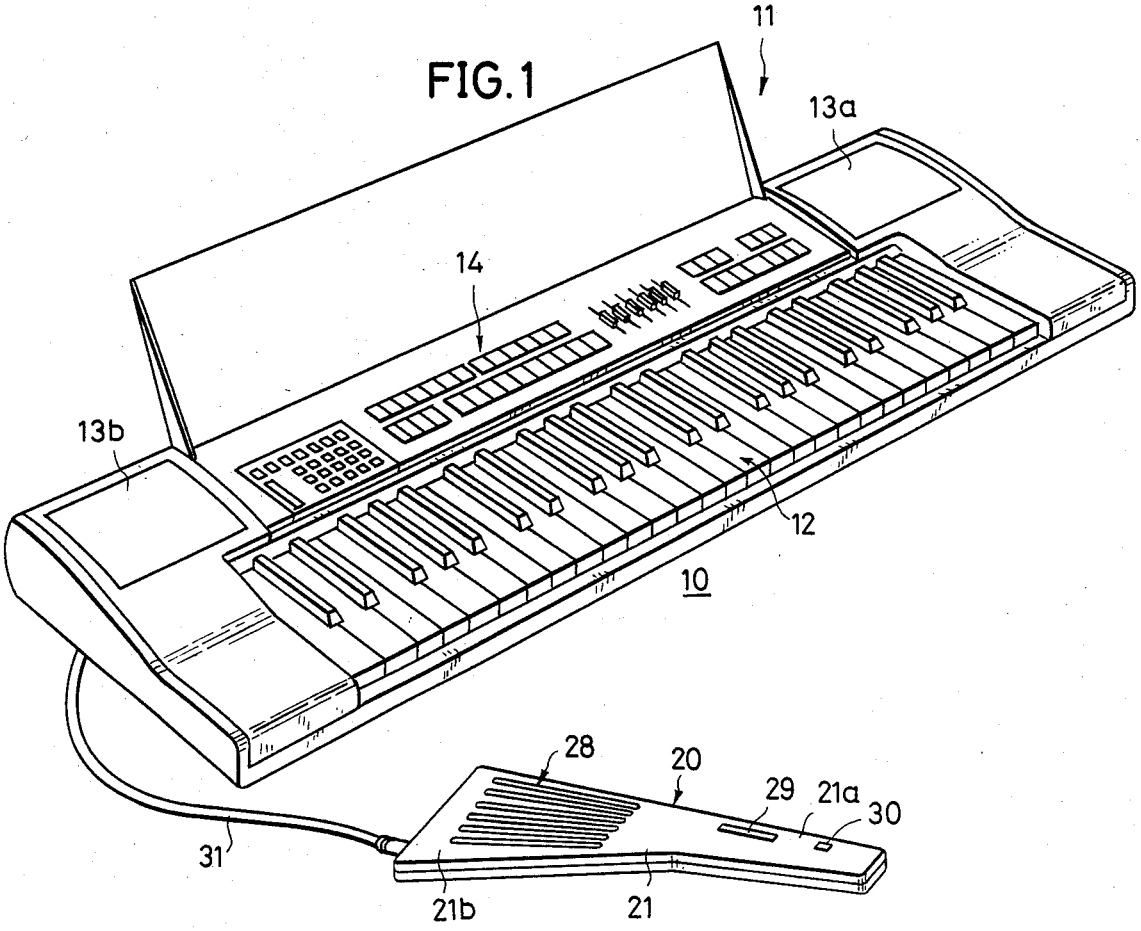
FIG. 1 is a perspective view showing a main electronic keyboard instrument body and a remote playing unit coupled thereto of an embodiment of the electronic instrument according to the present invention.

In FIG. 1, a main electronic keyboard instrument body (hereinafter simply referred to as a main instrument body) 11 of an electronic instrument 10 according to the present invention, has a construction similar to that of the conventional electronic keyboard instrument. Keys of a keyboard 12 are arranged at the front of the main instrument body 11, and speakers 13*a* and 13*b* are arranged on the right and left of the main instrument body 11. The main body 11 also comprises a switch group 14 made up of various manipulation switches.

Figure 2:
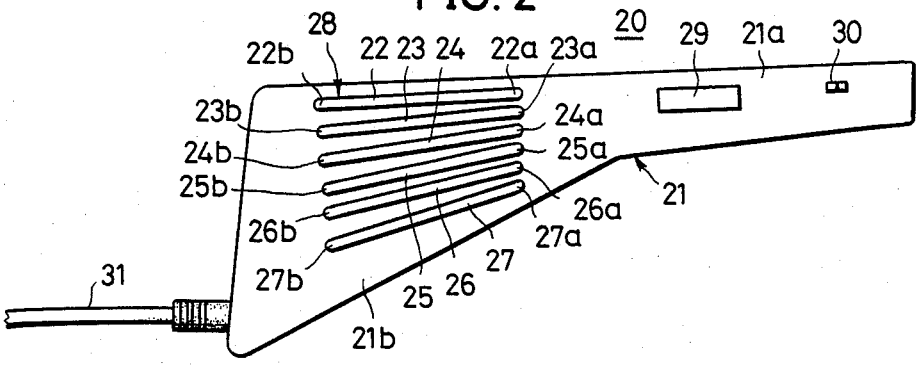
FIG. 2 is a plan view showing the remote playing unit.

A remote playing unit 20 is electronically coupled to the main body 11 by way of a cord 31. As shown in FIG. 2, the unit 20 comprises a plate shaped main unit body 21. The main unit body 21 is made up of a holding part 21*a* which is held by the player's left hand as in the case of the neck of the guitar, and a triangular part 21*b* which continues from the holding part 21*a*. For example, six elongated bar switches 22 through 27 which correspond to the six strings of the guitar, are arranged side by side on the triangular part 21*b*. The bar switches 22 through 27 constitute a bar switch group 28. An interval between two mutually adjacent bar switches out of the bar switches 22 through 27 is narrow at ends 22*a* through 27*a* of the bar switches 22 through 27 and is wide at the other ends 22*b* through 27*b* of the bar switches 22 through 27. In other words, the bar switches 22 through 27 are disposed in a non-parallel arrangement, approximately in a fan shape. A mute switch 29 and an ON/OFF switch 30 for operating the unit 20, are provided on the holding part 21*a*. The mute switch 29 is manipulated when muting the sound which is generated by the manipulation of the bar switch group 28, and it is possible to perform an operation similar to the case where a guitar player holds the six strings of the guitar by his hand to mute the sound. The ON or OFF state of the unit 20 is determined by the ON or OFF state of the ON/OFF switch 30.

Figure 3:
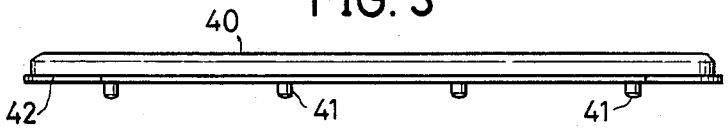
FIG. 3 is a side view showing the construction of a key top of a bar switch of the remote control unit shown in FIG. 2.
Figure 4:
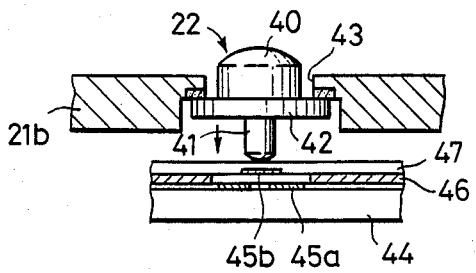
FIG. 4 is a front view in vertical cross section showing a bar switch of the remote playing unit shown in FIG. 2.

Each of the bar switches 22 through 27 of the bar switch group 28 has the same construction, and the construction of the bar switch 22 will be described as an example. As shown in FIG. 3, a key top 40 of the bar switch 22 has an elongated rod shape, and four projections 41 are formed on the lower surface of the key top 40. FIG. 4 shows the vertical cross section of the bar switch 22. The key top 40 fits into a groove 43 which is formed in the triangular part 21*b* of the main unit body 21, and a flange 42 of the bar switch 22 makes contact with the peripheral edge part of the groove 43 on the lower surface of the triangular part 21*b*. A contact 45*a* is provided on the upper surface of a base plate 44, and a film 47 having a contact 45*b* is disposed on the base plate 44 by way of a spacer 46. The projection 41 of the key top 40 makes contact with the upper surface of the film 47. Four switch parts, each of which is made up of the contacts 45*a* and 45*b*, are provided a four positions on the base plate 44 in correspondence with the four projections 41. The four switch parts are connected in parallel, and the bar switch becomes closed when one of the switch parts closes. Accordingly, at least one of the four projections 41 closes the corresponding opposing switch part regardless of the part whereat the key top 40 is pushed, and the bar switch 22 is closed when the switch part closes. Because the key top 40 is in contact with the film 47 by way of the four projections 41, the weight (for example, 10 g) of the key top 40 itself is distributed at four positions and the weight applied at one position is extremely small. On the other hand, the contacts 45*a* and 45*b* which oppose each other through a hole in the spacer 46, are normally separated from each other and the switch is open. Hence, when a pushing force acts downwardly on the key top 40, the projections 41 push and deform the film 47, and the switch part is closed when the contact 45*b* makes contact with the contact 45*a*. For example, it requires a force in the order of 30 g to 50 g to deform the film 47 and obtain the contact between the contacts 45*a* and 45*b*. In a normal state where no pushing force is applied on the key top 40, the weight of the key top 40 itself is distributively applied on the film 47 by way of the projections 41, but the distributively applied force is smaller than the force required to obtain contact between the contacts 45*a* and 45*b*. As a result, the switch part constituted by the contacts 45*a* and 45*b* remains open in the normal state.

Figure 5:
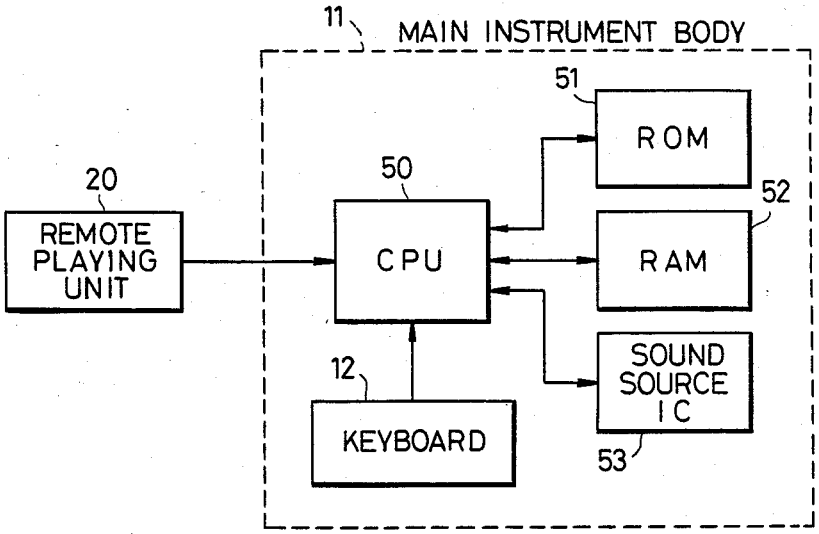
FIG. 5 is a general system block diagram showing the electronic instrument shown in FIG. 1.

As shown in FIG. 5, the main instrument body 11 has a built-in central processing unit (CPU) 50, a read only memory (ROM) 51, a random access memory (RAM) 52, and a sound source integrated circuit (IC) 53. When playing the electronic instrument 10 by use of the unit 20, the cord 31 of the unit 20 is connected to the main instrument body 11, and the ON/OFF switch 30 is turned ON.

Figure 6:
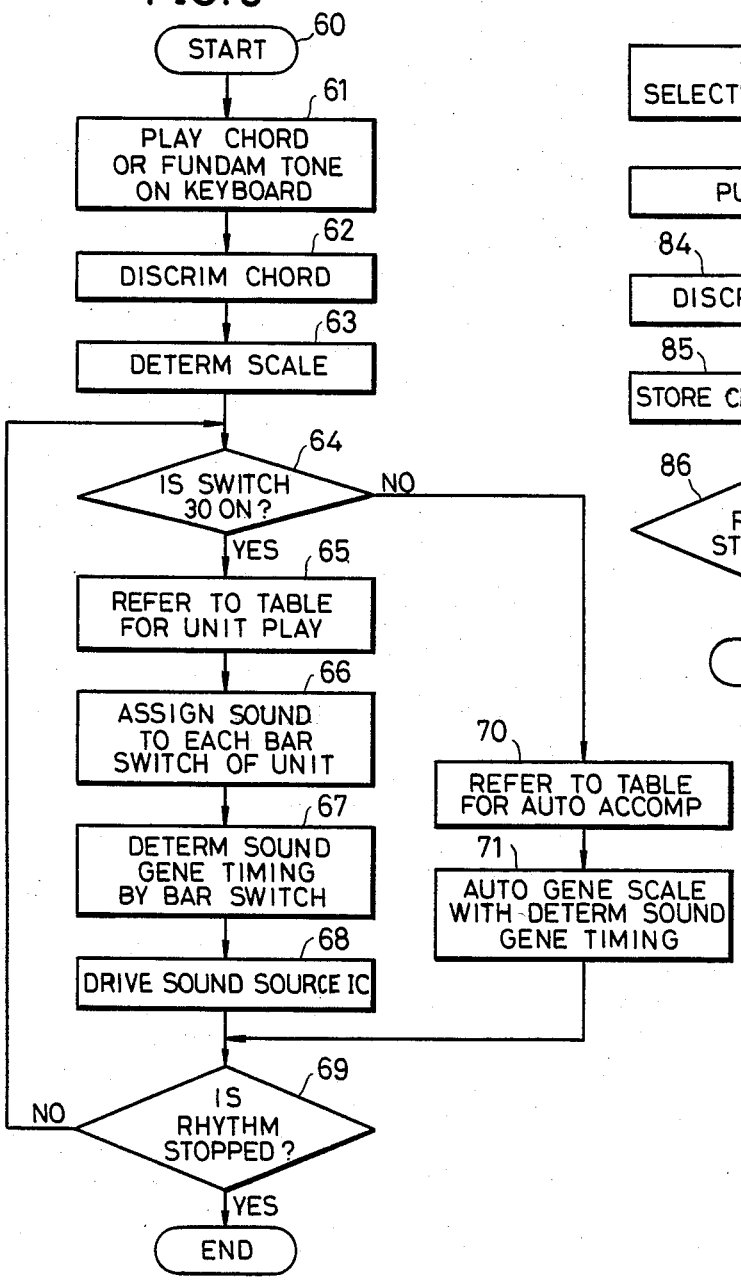
FIG. 6 is a flow chart for explaining the operation of a CPU shown in FIG. 5 when playing the instrument without assigning the sounds of the scale to the bar switches of the remote playing unit beforehand.

When playing the electronic instrument 10 without storing the chord which is to be played, the operation is started from the step 60 shown in FIG. 6, for example. In accordance with the rhythmical sound automatically generated by the main instrument body 11 or the sound generated by other instruments, a chord which matches with the sound or a fundamental tone of the chord is played on the keyboard 12 in a step 61. In a step 62, the CPU 50 discriminates the chord responsive to the manipulation of the keyboard 12. The scale of the sound which is to be generated is determined in a step 63 based on the discriminated chord. In a step 64, a discrimination is made to determine whether or not the ON/OFF switch 30 is turned ON. When the discrimination result in the step 64 is YES, a reference is made to a table for unit play in a step 65, which table is stored in the ROM 51. The sounds of the determined scale are assigned to each of the bar switches 22 through 27 in a step 66. For example, in the case where the chord is C-major, the sounds of C, E, and G of the scale are respectively assigned to the bar switches 22 through 24, and the sounds of C, E, and G of a scale which is higher by an octave are respectively assigned to the bar switches 25 through 27. When the bar switches 22 through 27 of the unit 20 are sequentially pushed along one direction as in the case of strumming the six strings of the guitar and the bar switches 22 through 27 are closed sequentially, the CPU 50 determines the sound generation timing in a step 67 responsive to the timing with which the bar switches 22 through 27 are closed. The sound IC 53 is driven in a step 68, and the sound is generated through the speakers 13*a* and 13*b*. A slight force is sufficient to push and close the bar switches 22 through 27, and the player can close the bar switches 22 through 27 by touching the bar switches in sequence by his finger.

Accordingly, when the player sequentially touches the bar switches 22 through 27 by his finger along one direction, it is possible to generate in a manner similar to the strumming of the guitar the sounds of the scale of the chord based on the sound designated by the keyboard 12. When a chord suited for a bar (measure) of a music is designated on the keyboard 12 for every bar of the music, for example, it is possible to easily generate the sounds of the chord as the sound generated when the guitar is played by the strumming method. Until it is discriminated in a step 69 that the rhythm has stopped, the operation returns to the step 64, and the steps 64 through 69 are performed repeatedly.

On the other hand, when the discrimination result in the step 64 is NO, that is, when the electronic instrument 10 is to be played without using the unit 20, the following operation is performed although such an operation is unrelated to the subject matter of the present invention. The CPU 50 makes reference to a table for automatic accompaniment in a step 70, which table is stored in the ROM 51. In a step 71, the sound source IC 53 is driven with the sound generation timing which is determined beforehand, and the sounds which are determined as a result of making the reference to the table are generated.

The keyboard 12 and the bar switches 22 through 27 of the unit 20 may be manipulated by different persons, or the keyboard 12 and the bar switches 22 through 27 may be manipulated by one person by use of his hands.

As described before, the bar switches 22 through 27 are arranged so that the interval between two adjacent bar switches is narrow at the ends 22*a* through 27*a* but is wide at the other ends 22*b* through 27*b*. Thus, when manipulating the bar switches 22 through 27 of the unit 20, it is possible to quickly play the electronic instrument by the strumming method with ease by manipulating the bar switches 22 through 27 closer to the ends 22*a* through 27*a*. On the other hand, it is possible to slowly play the electronic instrument 10 by the strumming method with ease by manipulating the bar switches 22 through 27 closer to the other ends 22*b* through 27*b*. Further, it is easy for both an adult and a child to normally play the electronic instrument 10 by the strumming method. In the case of the child having small hands, the child can manipulate the bar switches 22 through 27 closer to the ends 22*a* through 27*a*, and the adult having big hands can manipulate the bar switches 22 through 27 closer to the other ends 22*b* and 27*b*.

Figure 7:
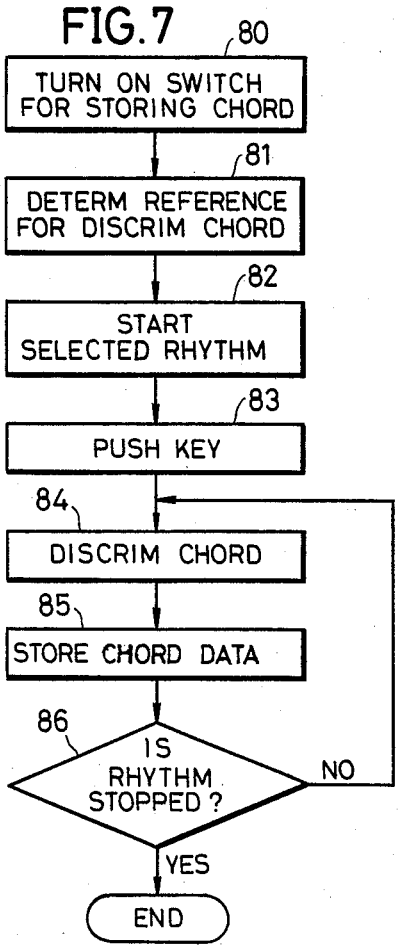
FIG. 7 is a flow chart for explaining the operation of the CPU when carrying out a storing operation to assign the sounds of the scales to each of the bar switches of the remote playing unit beforehand.

In the case where the electronic instrument 10 is to be played by assigning the sounds to each of the bar switches 22 through 27 of the unit 20 beforehand, a switch for storing the chord, which is in the switch group 14 of the main instrument body 11, is turned ON by the player in a step 80 shown in FIG. 7. The CPU 50 determines a reference for discriminating the chord in a step 81. When the player pushes a selected rhythm start switch in the switch group 14, the generation of the rhythmical sound of the selected rhythm is started in a step 82. The player pushes one or a plurality of keys of the keyboard 12 responsive to the chord or the fundamental tone of the chord in a step 83, in accordance with the rhythm by listening to the generated rhythmical sound. The CPU 50 discriminates the chord in a step 84 in accordance with the manipulation of the keyboard 12, and the chord data is stored in the RAM 52 in a step 85. Until it is discriminated in a step 86 that the rhythm has stopped, the operation is returned to the step 84 and the steps 84 through 86 are performed repeatedly so as to successively store the chords in accordance with the key or keys of the keyboard 12 manipulated in the step 83. When the storage of the chords is completed and the rhythm stops, the chord storing operation is ended.

Figure 8:
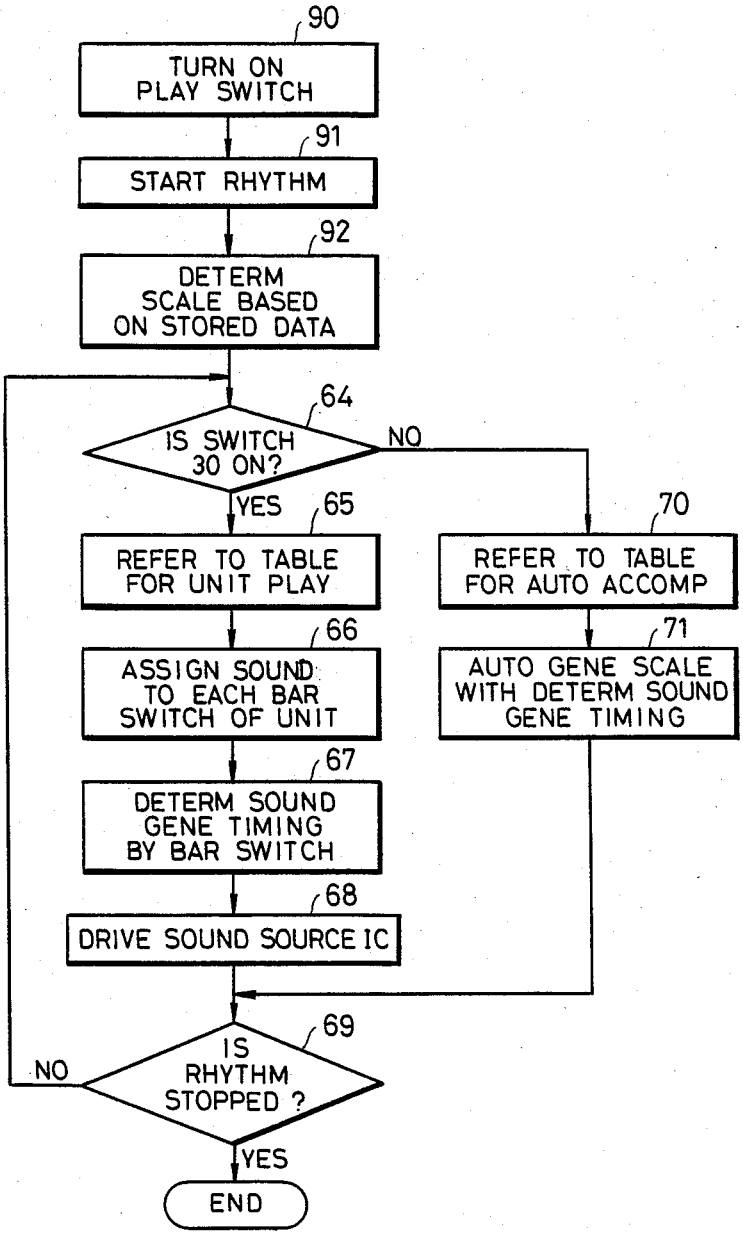
FIG. 8 is a flow chart for explaining the operation of the CPU when playing the instrument with the remote playing unit in a state where the sounds of the scale are assigned to each of the bar switches by the operation described by the flow chart shown in FIG. 7.

Next, when playing the electronic instrument 10, a play switch in the switch group 14 is turned ON in a step 90 shown in FIG. 8. The generation of the rhythmical sound is started in a step 91, and the CPU 50 determines the scale by the ROM 51 based on the stored data in the RAM 52 described before. The operations performed after the step 91 are the same as those of the steps 64 through 69 shown in FIG. 6. Hence, in FIG. 8, those steps which are the same as those corresponding steps in FIG. 6 are designated by the same reference numerals, and description thereof will be omitted. It is possible to play the pre-stored chord by the strumming method by manipulating the bar switches 22 through 27 of the unit 20 in accordance with the generated rhythm. In this case, when playing by the unit 20, it is unnecessary to simultaneously manipulate the keyboard 12 so as to designate the chord as in the case described before, and the playing is facilitated.

Further, the present invention is not limited to these embodiments, but various variations and modifications may be made without departing from the scope of the present invention.

What is claimed is:

1. An electronic instrument comprising:

a main electronic keyboard instrument body including a keyboard, sound generating means, and circuit means for discriminating chords responsive to manipulations of the keyboard and for determining a scale in accordance with said chords, said circuit means causing said sound generating means to generate sound in accordance with said determined scale with a designated timing; and a remote playing unit to be played by fingers which is detached from and electrically coupled to said main electronic keyboard instrument body, said remote playing unit comprising a plurality of elongated bar switches arranged side by side with such an interval between two mutually adjacent bar switches that each interval is small on one end of said bar switches and is large on another end of said bar switches, each of said bar switches being assigned with a pitch in accordance with said determined scale, a timing with which the sound of each pitch is generated by said main electronic keyboard instrument body being designated arbitrarily by manipulating and closing each of said bar switches, so that sound of a broken chord can be generated by sequentially manipulating said bar switches.

2. An electronic instrument as claimed in claim 1 in which six bar switches are provided on said remote playing unit in correspondence with six strings of a guitar.

3. An electronic instrument as claimed in claim 1 in which said remote playing unit comprises an approximately triangular part provided with said bar switches and a holding part unitarily extending from said approximately triangular part in the form of a neck of a guitar.

4. An electronic instrument as claimed in claim 3 in which said remote playing unit further comprises a mute switch for muting a trailing note generated by manipulations of said bar switches, and an ON/OFF switch for determining whether or not said remote playing unit is to be used.

5. An electronic instrument as claimed in claim 1 in which said circuit means of said main electronic keyboard instrument body comprises a read only memory for re-storing a predetermined program, a central processing unit for discriminating chords responsive to the manipulation of said keyboard and for determining the scale by said read only memory in accordance with the discriminated chords, and a sound source integrated circuit driven by said central processing unit for causing said sound generating means to generate the sound of the scale determined by said central processing unit.

6. An electronic instrument as claimed in claim 5 in which said circuit means of said main electronic keyboard instrument body further comprises a random access memory for storing chord data of the chords discriminated by said central processing unit, said central processing unit determining the scale by said read only memory based on the chord data stored in said random access memory.

7. An electronic instrument as claimed in claim 1 in which each of said bar switches of said remote playing unit comprises an elongated key top having a plurality of projections arranged on a lower surface thereof with an interval therebetween in the longitudinal direction, and a plurality of switch parts having contacts arranged opposing the respective projections on said key top.

* * * * *